United States Patent [19]

Tower

[11] Patent Number: 4,618,005

[45] Date of Patent: Oct. 21, 1986

[54] ORIENTABLE RIPPER

[76] Inventor: Douglass G. Tower, 724 Somerset Ave., Princess Anne, Md. 21853

[21] Appl. No.: 641,997

[22] Filed: Aug. 20, 1984

[51] Int. Cl.[4] ..... E02F 3/76; E02F 5/30; A01B 63/106; A01B 63/118

[52] U.S. Cl. ..... 172/459; 414/695; 172/463; 172/476; 172/253; 172/474; 37/2 R

[58] Field of Search ..... 172/474, 825, 484, 459, 172/494, 478, 456, 668, 460, 463, 476, 298, 796, 305, 253, 475, 797, 482, 445.2; 414/694, 695, 695.5; 405/268; 74/99 R, 104, 102; 182/65; 404/90; 37/2 R; 299/34, 36

[56] References Cited

U.S. PATENT DOCUMENTS

| | | | |
|---|---|---|---|
| 2,238,094 | 4/1941 | Allin | 37/2 R |
| 2,788,199 | 4/1957 | Ankersheil | 172/474 X |
| 2,847,134 | 8/1958 | Slate | 414/695 |
| 3,445,944 | 5/1969 | Speno | 172/459 |
| 3,503,456 | 3/1970 | Larson | 172/484 |
| 3,973,632 | 8/1976 | Torazzi | 172/474 |
| 4,063,597 | 12/1977 | Day | 172/126 |
| 4,124,080 | 11/1978 | McCanse | 172/445.2 |
| 4,466,491 | 8/1984 | Tower | 172/459 |
| 4,478,289 | 10/1984 | Enix | 172/464 |

*Primary Examiner*—Richard J. Johnson
*Attorney, Agent, or Firm*—Berman, Aisenberg & Platt

[57] ABSTRACT

An apparatus for attachment to a vehicle, preferably a bulldozer, comprises a first arm having a ripper shank extending therefrom which is pivotally attached to a second arm. A second arm is mounted to a vehicle for rotation about a horizontal axis so that when the first and second arms are in one orientation the ripper shank may be operated to move in a plane transverse to the direction of motion of the vehicle. The apparatus may be rotated to any angle such that the shank extends forwardly, or rearwardly, of the vehicle to engage objects. In the preferred embodiment, the first and second arms are pivotally mounted to a journal which extends through a mounting housing. A hydraulic cylinder engages one end of the journal at an eccentric location to cause the journal to rotate upon activation of the hydraulic cylinder.

1 Claim, 2 Drawing Figures

ORIENTABLE RIPPER

FIELD OF THE INVENTION

This invention relates to the art of apparatus adapted to be attached to heavy equipment such as bulldozers, or the like.

BACKGROUND ART

It is known to attach an apparatus to a vehicle such as a bulldozer for engaging the ground or objects, such as rocks, which are embedded in the ground. U.S. Pat. No. 3,503,456 (Larson) shows an apparatus which is attached to the rear of a bulldozer and includes a ripper which extends downwardly from the apparatus to engage rocks or other objects. U.S. Pat. No. 2,238,094 (Allin) shows a stump splitter which is attached to the bull arm of a bulldozer and extends outwardly and forwardly of a blade to engage tree stumps.

My copending application, Ser. No. 393,614, filed June 30, 1982 now U.S. Pat. No. 4,466,491, discloses a side ripper adapted to be mounted to the side of a vehicle. A ripper tip is mounted to a first arm which is pivotally attached to a second arm which in turn is pivotally attached to the vehicle. The side ripper is arranged for rotation in a plane transverse to the direction of motion of the vehicle such that embedded objects such as rocks, may be removed more easily than in the prior art. The disclosure of my prior application is hereby incorporated by reference.

SUMMARY OF THE INVENTION

In accordance with the invention, an apparatus similar to my prior side ripper is mounted to a journal for rotation about an axis transverse to the direction of motion of a vehicle. This allows the apparatus to assume a first orientation wherein it operates substantially the same as the side ripper described in my prior application, but also permits the ripper tip to be rotated to extend forwardly of the vehicle to engage other objects. Thus, a wider variety of uses is obtained.

A first arm includes a ripper tip and is pivotally attached to a second arm. The second arm is attached to a rotational means which is in turn fixed to a vehicle. The rotational means preferably comprises a housing having an opening therein and a journal for extending through the opening. The first and second arms rotate as the journal rotates and the second arm is preferably pivotally mounted to the journal. The journal is caused to rotate by a hydraulic cylinder having one end attached to an eccentric location on the journal and a second end attached to the vehicle.

It is an object of this invention to provide an apparatus wherein, in one orientation, a ripper is mounted for movement in a plane transverse to the direction of motion of a vehicle, and in a second orientation, moves in a plane parallel the direction of motion of the vehicle.

DETAILED DESCRIPTION OF THE DRAWINGS

Figure 1:
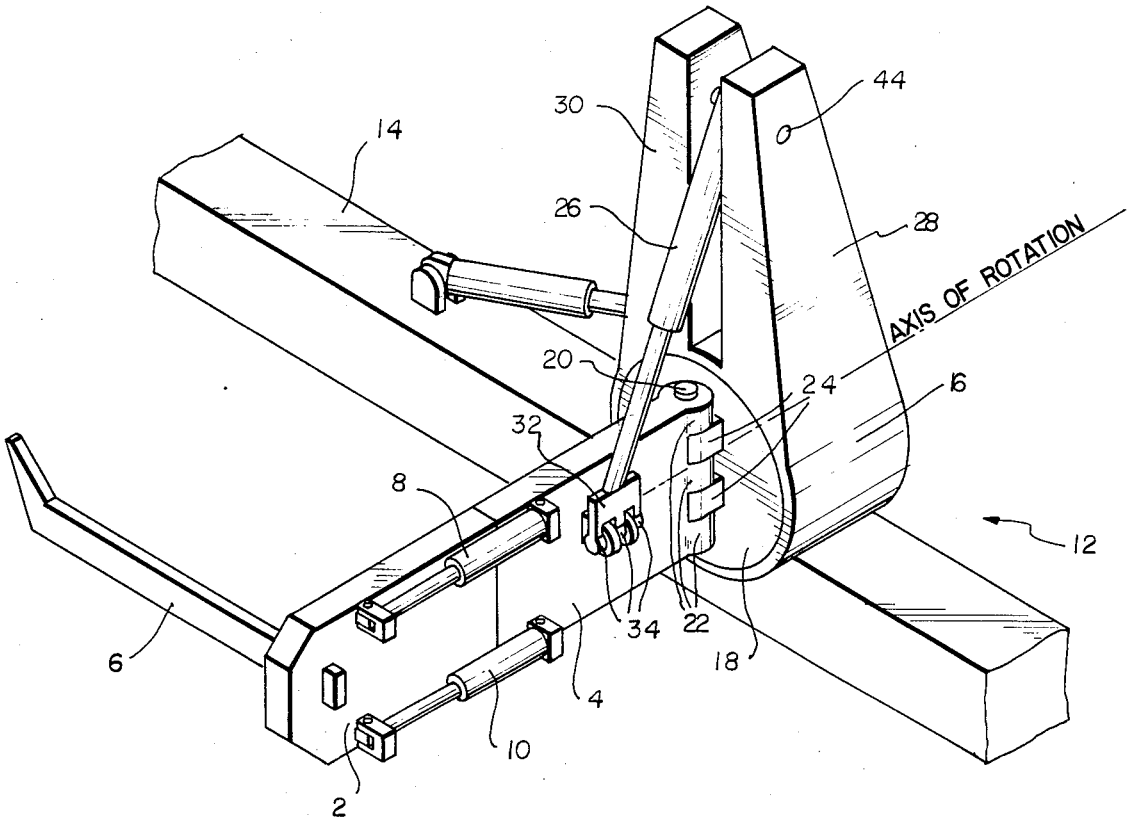
FIG. 1 is a perspective view of an apparatus in accordance with the invention.

With reference to FIG. 1, a first arm is pivotally attached to a second arm 4. A ripper shank 6 extends outwardly of the first arm 2 to engage embedded objects, or the like. Hydraulic cylinders 8 and 10 are connected between the first arm 2 and second arm 4 to cause rotation of the first arm with respect to the second arm. Reference is made to my prior copending application for additional construction details.

A rotational mounting means 12 is attached to a vehicle, and is shown in FIG. 1 to be attached to a bull arm 14 of a bulldozer. As is known in the art, the bull arm 14 is pivotally attached to the bulldozer for movement in a vertical plane and typically supports an earth-moving blade. The rotational mounting means 12 includes a housing 16 which has an opening therethrough for receiving a journal 18. Journal 18 is mounted for rotation with respect to housing 16 about a horizontal axis. In a preferred embodiment, second arm 4 is mounted to journal 18 by a hinge pin 20 whereby the second arm 4 may rotate with respect to journal 18 about an axis defined by the hinge pin 20. Second arm 4 preferably includes a plurality of bosses 22, and journal 18 includes a plurality of complimentary bosses 24. These bosses engage the hinge pin 20 to permit pivotal movement.

When the journal 18 is rotated to such a position that hinge pin 20 is horizontal, rotational movement of arm 4 may be effected by a hydraulic cylinder 26. One end of hydraulic cylinder 26 is attached to upstanding pillars 28 and 30, and a second end is attached to a mounting bracket 32. Bracket 32 includes bosses 34 which engage complimentary bosses on the second arm 4 to permit rotation of the bracket as the arm 4 and journal 18 rotate.

Figure 2:
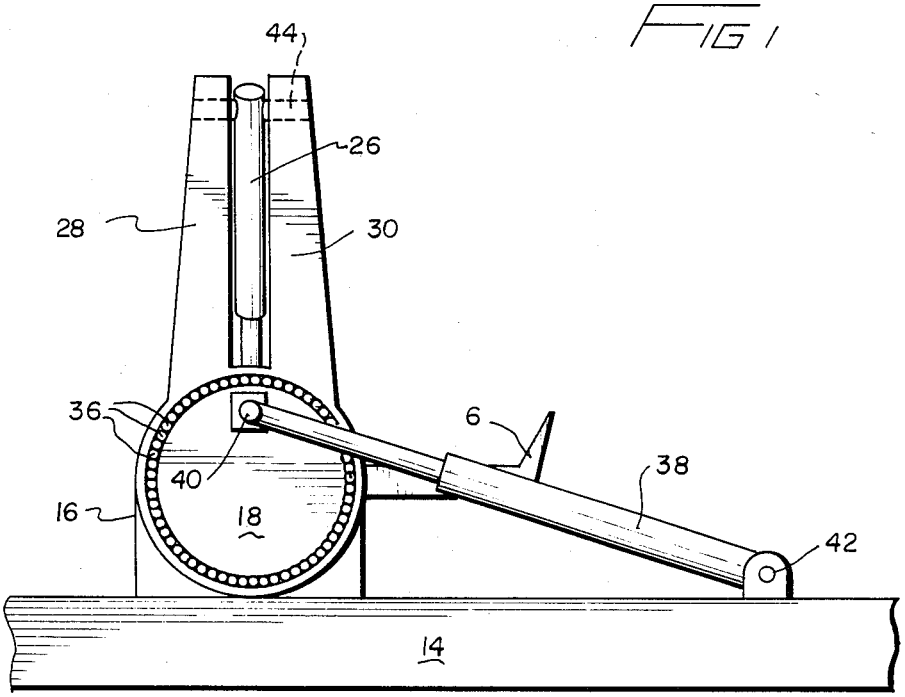
FIG. 2 is a side view of the apparatus shown in FIG. 1.

FIG. 2 is an end view of the apparatus shown in FIG. 1 and illustrates a preferred means for rotating journal 18. Also shown are a plurality of bearings 36 which are located between the outer surface of the journal 18 and the interior of the housing 16 to facilitate movement. These are preferably needle bearings, but may be of other known types.

A hydraulic cylinder 38 is attached to the journal 18 at a bracket 40, and a second end of the hydraulic cylinder 38 is attached to the bull arm 14 by bracket 42. It will be appreciated that bracket 40 is located off-center with respect to the axis of rotation of journal 18 so that a linear action of the hydraulic cylinder 38 will cause journal 18 to rotate. Bracket 40 may simply be a knob extending outwardly from the journal 18 or it may be a U-shaped bracket. It will be appreciated that a knob-like extension will permit 360 degree rotation of journal 18, while a U-shaped bracket will permit only a partial rotation of the journal 18. Of course, other rotating mechanisms may be employed.

The upper end of hydraulic cylinder 26 is attached to the pillars 28 and 30 by a pin 44 which extends between the pillars.

In operation, the operator of a vehicle preferably has a plurality of control mechanisms to control the operation of hydraulic cylinders 8, 10, 26 and 38. Hydraulic cylinder 38 may be operated to place the axis of hinge 20 horizontal whereby cylinders 8, 10, and 26 may be operated to control the location of the ripper 6 as described in my prior copending application. When it is desired to rotate ripper 6 to extend forwardly, or rearwardly, the operator need merely activate hydraulic cylinder 38 to cause journal 18 to rotate. When the ripper 6 extends forwardly, objects in front of the vehicle can be engaged. If cylinders 8 and 10 are activated, arm 2 will be pulled parallel to bull arm 14 whereby ripper 6 will extend at various angles in a plane parallel to the ground. If the cylinders are operated to move arm 2 continuously, ripper 6 will move back-and-forth to dig out an embedded object. Since journal 18 may be placed at any angle, a similar operation is possible in any plane from horizontal to vertical.

It will be appreciated that an extremely versatile apparatus has been described wherein many advantages of two different types of rippers are obtained. Modifications within the scope of the appended claims will be apparent to those of skill in the art.

What is claimed is:

1. Apparatus comprising rotational tool mounting means for being attached to a vehicle, said rotational mounting means comprising a bearing housing, a rotatable journal received by said bearing housing for rotation about a first axis, and said bearing housing upstanding pillar means extending in a direction transverse to said first axis for supporting a first power means, second power means for rotating said journal, second arm means pivotally connected to said journal for rotation with respect to said journal about a second axis transverse to said first axis, first arm means pivotally connected to said second arm means for rotation about a third axis parallel to said second axis, ripper means secured to and extending transversely to said first arm means, third power means connected between said first and second arm means for controlling the angular relationship about said third axis, said first power means extending between said pillar means and a pivotal connector means on said first arm means, said pivotal connector means attaching said first power means to said second arm means and allowing relative pivotal movement between said first power means and said second arm means.

* * * * *